US006758460B1

(12) United States Patent
Driscoll et al.

(10) Patent No.: US 6,758,460 B1
(45) Date of Patent: Jul. 6, 2004

(54) DEVICE AND METHOD FOR ATTACHING BALUSTERS

(75) Inventors: Terry L. Driscoll, Rochester, MN (US); Aaron K. Stadsvold, Oronoco, MN (US)

(73) Assignee: Custom Iron, Inc., Zumbrota, MN (US)

( * ) Notice: Subject to any disclaimer, the term of this patent is extended or adjusted under 35 U.S.C. 154(b) by 0 days.

(21) Appl. No.: 09/842,566

(22) Filed: Apr. 25, 2001

Related U.S. Application Data

(62) Division of application No. 09/100,913, filed on Jun. 19, 1998.

(60) Provisional application No. 60/050,208, filed on Jun. 19, 1997.

(51) Int. Cl.[7] ..... E04H 17/14

(52) U.S. Cl. ..... 256/65.05; 256/65.14

(58) Field of Search ..... 403/365, 368, 403/367, 383, 361, 377; 256/59, 22, 68, 65.01, 65.02, 65.03, 65.04, 65.05, 65.14, 65.15

(56) References Cited

U.S. PATENT DOCUMENTS

| | | | | |
|---|---|---|---|---|
| 148,061 A | | 3/1874 | Holden | |
| 281,077 A | | 7/1883 | Jones | |
| 361,542 A | | 4/1887 | Palmer | |
| 618,741 A | | 1/1899 | Sheer | |
| 2,654,579 A | | 10/1953 | Cremens | |
| 2,820,613 A | | 1/1958 | Schilling | |
| 3,004,751 A | | 10/1961 | Woodward | |
| 3,239,196 A | | 3/1966 | Blum et al. | |
| 3,306,586 A | | 2/1967 | Green | |
| 3,704,004 A | | 11/1972 | Carter, Jr. | |
| 3,847,489 A | | 11/1974 | Van Riper | |
| 3,918,686 A | | 11/1975 | Knott et al. | |
| 4,035,978 A | | 7/1977 | Bajorek et al. | |
| 4,050,828 A | | 9/1977 | Nore | |
| 4,108,422 A | | 8/1978 | Fleischmann | |
| 4,272,061 A | | 6/1981 | Suckno | |
| 4,373,310 A | | 2/1983 | Dean | |
| 4,403,767 A | | 9/1983 | Basey | |
| 4,421,302 A | | 12/1983 | Grimm | |
| 4,475,840 A | | 10/1984 | Schmitt et al. | |
| 4,533,074 A | | 8/1985 | Van Thiel | |
| 4,898,365 A | | 2/1990 | Conner et al. | |
| 4,986,513 A | | 1/1991 | Schultz et al. | |
| 5,029,820 A | * | 7/1991 | Katz | 256/65.14 X |
| 5,069,570 A | * | 12/1991 | Pryor et al. | 403/377 X |
| 5,150,885 A | | 9/1992 | Leone | |
| 5,765,812 A | | 6/1998 | Guenther | |
| 6,015,138 A | * | 1/2000 | Kohlberger et al. | 256/65.14 X |

FOREIGN PATENT DOCUMENTS

| | | |
|---|---|---|
| DE | 3511770 | 10/1986 |
| GB | 1166344 | 10/1969 |

* cited by examiner

*Primary Examiner*—John R. Cottingham
(74) *Attorney, Agent, or Firm*—Fredrikson & Byron, P.A.

(57) ABSTRACT

One embodiment of the present invention is a device for attaching a polygonal baluster end to a handrail or base. This device includes a connector which is generally cylindrical. This connector also defines an internal axial channel having a polygonal cross-section. The axial channel is adapted to receive the polygonal baluster end.

8 Claims, 8 Drawing Sheets

DEVICE AND METHOD FOR ATTACHING BALUSTERS

CROSS REFERENCE TO RELATED APPLICATIONS

This application is filed as a divisional application of U.S. Ser. No. 09/100,913, filed Jun. 19, 1998 for DEVICE AND METHOD FOR ATTACHING BALUSTERS.

FIELD OF THE INVENTION

The present invention generally relates to the attachment of balusters, and more particularly to the attaching of metal balusters to wood bases and handrails.

BACKGROUND OF THE INVENTION

Historically metal balusters have been attached to metal handrails. When a wood handrail is desired, it is still attached to a sub-rail of metal which is subsequently attached to the metal balusters. Also, metal balusters have historically been attached to a metal base rail that is attached directly to the floor or stair, or is located several inches above the floor level and is attached at 5 to 6 foot intervals to a newel post. When metal balusters are attached directly to a floor or stair, the common method is to use a flanged base plate.

More recently, a new method of attachment has evolved. Metal balusters are glued or otherwise fastened directly to a wood handrail and base, omitting the sub-rail and base rail. This allows the components to be assembled by an installer at the job site, instead of in a metal fabricators shop. This saves significant time and money. This also puts important control of the installation schedule in the hands of the building contractor.

However, identification of simple, cost effective methods of connecting these components has provided significant challenges to the construction industry.

When portions of a baluster which contact the base and handrail are generally round, it is simple for the installer to drill a similarly sized round hole for the insertion of the baluster. However, many balusters have end cross-sections which are not round. Frequently, these balusters have generally square cross-sections.

The two most common techniques for dealing with this situation have been to chisel a square hole in the base or handrail, or to drill a round hole large enough to accept the square baluster and cover the resulting gaps with an escutcheon. Both of these methods present significant drawbacks.

The process of chiseling square holes in the wood base and handrail is both time consuming and requires significant skill to create a smooth, tight-fitting, aligned opening. In spite of these difficulties, consumer preference and certain railing styles often require installation of balusters without the use of escutcheons.

Even in those cases where the use of escutcheons is desirable, the escutcheons presently available are generally manufactured by sand casting or metal stamping. These processes have significant disadvantages. Sand castings require significant clean up before use to provide both dimensional requirements and physical appearance, while metal stamping is limited in the variations of appearance of the finished product.

In some cases it is necessary or preferable to attach the baluster to the base or handrail without drilling a hole large enough to receive the baluster into the base or handrail.

Unfortunately, connection hardware presently available utilizes exposed mechanical fasteners in a flanged escutcheon which diminishes the final appearance of the railing assembly.

Therefore, it would be advantageous to have a device and method to attach balusters to bases and handrails which did not require chiseling or escutcheons. In addition, if escutcheons are desirable, then the escutcheons would be inexpensive, with controlled dimensions, and improved finished appearance. Finally, if large holes are not desirable in the base or handrail, then escutcheons that utilize mechanical fasteners having a substantially concealed fastening method.

SUMMARY OF THE INVENTION

One embodiment of the present invention is a device for attaching a polygonal baluster end to a handrail or base. This connector is generally cylindrical and defines an internal axial channel having a polygonal cross-section. The axial channel is adapted to receive said polygonal baluster end. Additionally, the connector is adapted to be inserted into a generally circular opening in a handrail or base. In a further embodiment, the internal axial channel has a polygonal cross-section which is substantially square. This connector can be made of wood, metal, plastic or other suitable material. If desired, the connector's external diameter can be tapered to facilitated insertion into the generally circular opening of the handrail or base.

The present invention also envisions a railing kit which includes a baluster having at least one end with a polygonal cross-section and a connector which is generally cylindrical. This connector defines an internal axial channel having a polygonal cross-section generally the same as that of the baluster end. This channel receives the baluster end. In addition, this kit includes a handrail adapted to receive the connector.

Another embodiment of the present invention is a method for connecting a baluster to a base or handrail which includes the following steps. Providing a baluster having at least one end with a polygonal cross-section. Providing a connector which is generally cylindrical, where the connector defines an internal axial channel having a polygonal cross-section generally the same as that of the baluster end. Providing a suitable base or handrail with a generally circular opening with a diameter substantially that of the connector. Inserting the connector substantially into this opening, and inserting the baluster end into the internal axial channel.

An additional embodiment is a method of manufacturing a baluster escutcheon which includes the following steps. Selecting a baluster having at least one end with a polygonal cross-section. Extruding metal into an extrusion which defines an internal axial channel having substantially the same cross-sectional profile of the baluster end, and severing the extrusion at a pre-selected axial length to form a extruded part.

One may also perform the step of forming at least one substantially cylindrical axial passage placed generally about the periphery of the severed extruded part. This passage is adapted to receive a fastener.

A further embodiment is a device for attaching a baluster end to a handrail or base that includes a connector having a bottom edge, where the connector defines an internal axial channel having a polygonal cross-section which is adapted to receive a baluster end. Also included are at least one stud contacting the connector's bottom edge to facilitate the attachment of the connector to a handrail or base.

The present invention also includes a device for attaching a baluster end to a handrail or base that comprises a connector having top and bottom ends. This connector defines a first axial recess in the connector's top end which is adapted to receive a baluster end. The connector further defines a generally cylindrical axial orifice passing from the recess to the connector's bottom end which is adapted to receive a fastener.

An additional embodiment includes a connector that also defines a second recess in the connector's bottom end. The generally cylindrical axial orifice then passes from the first top end recess to the second bottom end recess and is adapted to receive a fastener.

DETAILED DESCRIPTION OF THE PREFERRED EMBODIMENT

Figure 1:
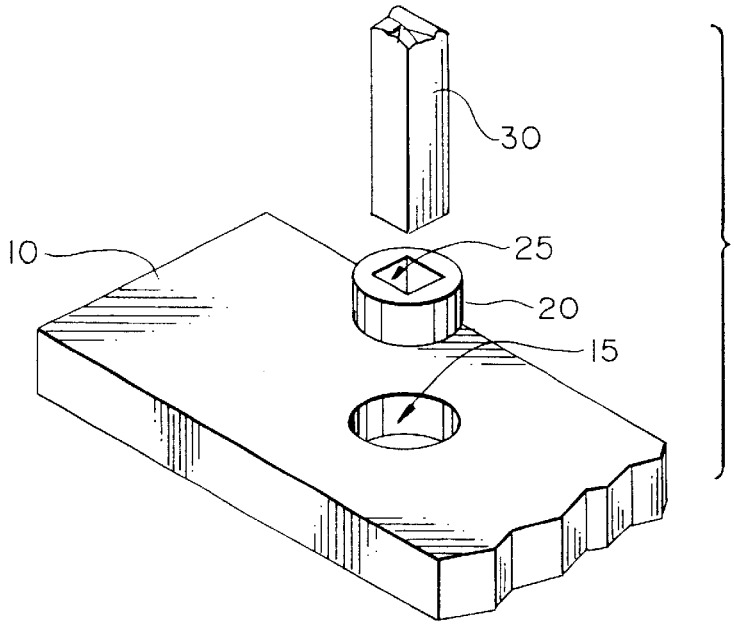
FIG. 1 is a side view of one embodiment of the invention showing a baluster, connector, and base.
Figure 2A:
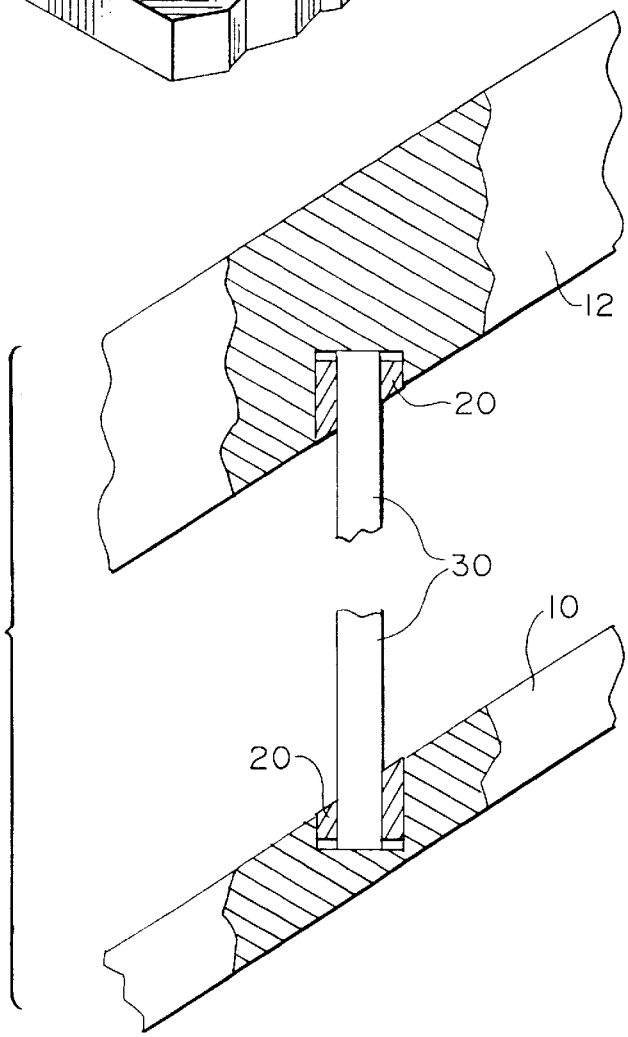
FIGS. 2A, 2B, & 2C are cross-sectional views of the several embodiments of the present invention showing handrails, balusters, bases and connectors.

As shown in FIGS. 1 and 2A, one embodiment of the present invention includes a connector 20. The connector 20 serves to join the baluster 30 to the base 10. Commonly this base 10 would be a stair, floor or other solid surface where the baluster is to be attached. The connector 20 also serves to join the baluster 30 to a handrail 12.

Connector 20 is generally cylindrical and has an internal axial channel 25 passing through its interior. The internal channel 25 has a polygonal cross-section which is designed to receive baluster 30. In some cases this channel 25 may be merely a recess sufficient to receive baluster 30.

The channel 25 or recess may have a large variety of cross-sectional shapes. This is dependent on the particular baluster 30 being used. Most commonly, the cross-section shape of the axial channel 25 will be substantially square.

The connector 20 is designed to fit within the circular opening 15 placed in the base 10 or handrail 12. The opening 15 may be pre-formed in the base 10 or handrail 12, or the may be drilled at the time of installation.

The connector 20 may be further secured by applying an adhesive. Any number of adhesives will work for this purpose including wood glue, epoxy, construction adhesive, or silicone adhesive. One may also wish to use an adhesive between the connector 20 and baluster 30.

The opening 15 is ideally sized to snugly fit the connector 20. This notwithstanding, if one wishes to use an adhesive to secure the connector 20 to the baluster 30 it is desirable to leave sufficient room in the respective opening so that the adhesive is not entirely forced out.

The connector 20 can be made out of a number of materials including wood, metal or plastic. Wood is the preferred material. The wood should be selected to match the woodwork of the base 10 and/or handrail 12. Common woods use for such purposes are Red Oak, Birch and Maple. If wood is chosen the connectors 20 may be cut with lasers, dies or similar processes know in the art.

Some common metals which may be used include aluminum, steel, brass, copper, and stainless steel. If metals are used, the connectors 20 may be formed by extrusion, die cut from sheets or similar processes know in the art.

While not as desirable as wood or metal, plastics may also be used in some cases. If plastics are chosen, the connectors 20 may be formed by injection molding, die cut from sheets or similar processes know in the art.

Depending on the particular starting material various finishes and designs may be use to enhance to appearance of the connector 20. When using wood it may be desirable to leave the connector 20 unfinished so that it may be stained to match the surrounding woodwork at the time of installation.

The connectors 20 can be made in a number of sizes depending on the particular balusters being used. The cylinder length of the connector 20 will also vary by the particular baluster and application, however, it would be generally preferably to have the cylinder length slightly less than the depth of the opening 15. It may also be desirable to taper the external diameter of the cylinder to facilitate easier insertion into the opening 15.

Figure 2B:
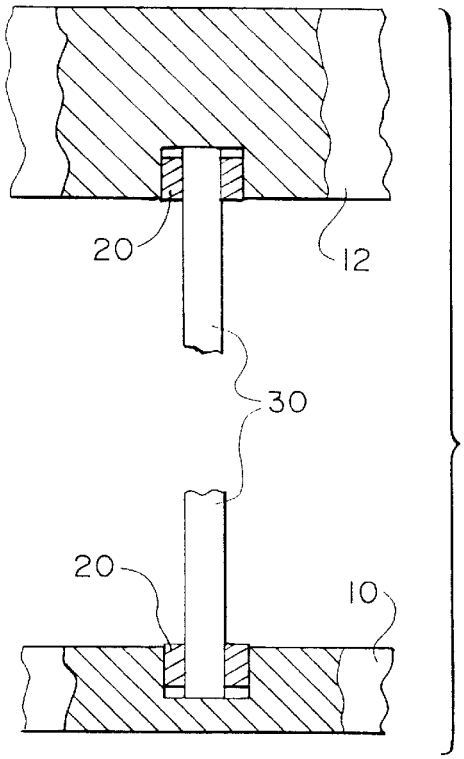
Figure 2C:
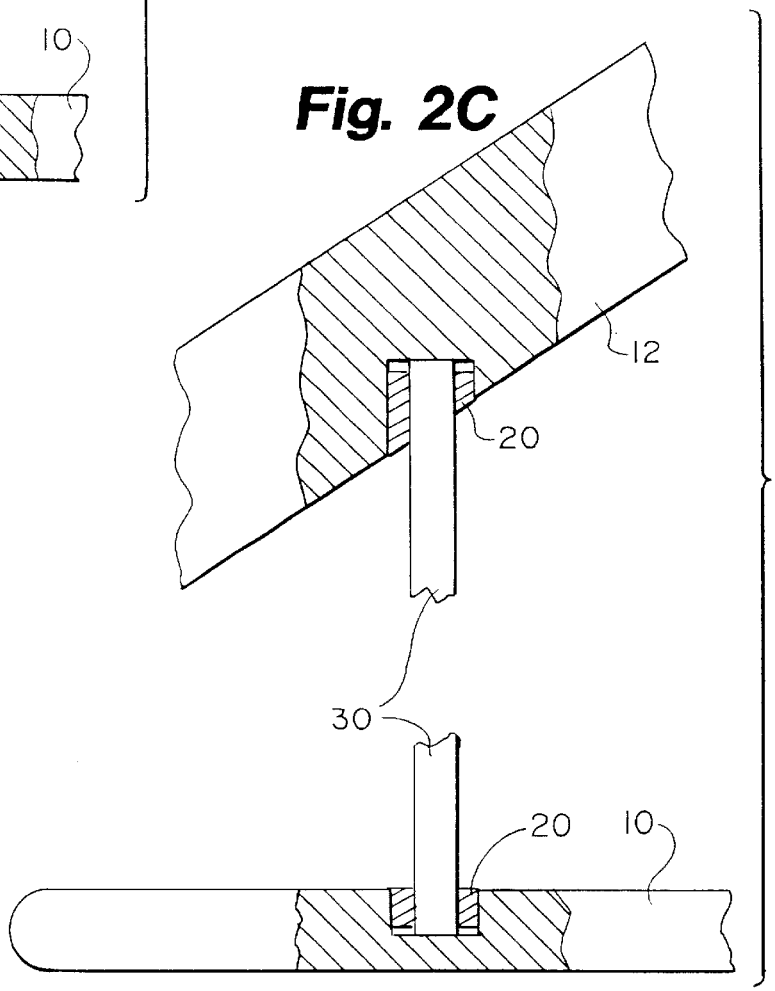
Figure 3A:
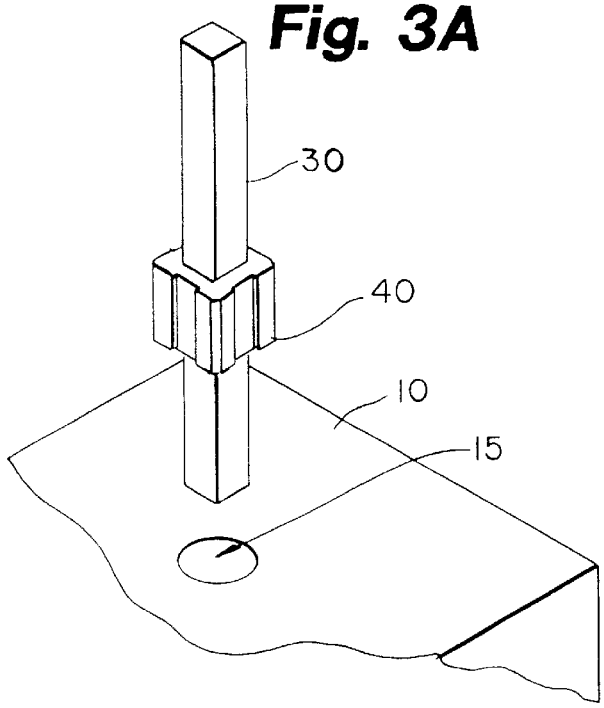
FIGS. 3A & 3B are side views of one embodiment of the invention showing a baluster, a base and a extruded escutcheon.
Figure 3B:
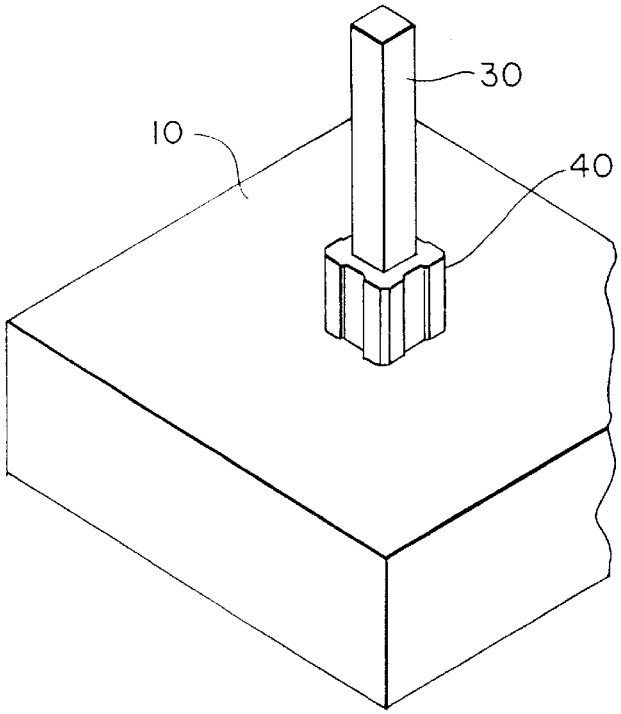
Figure 4A:
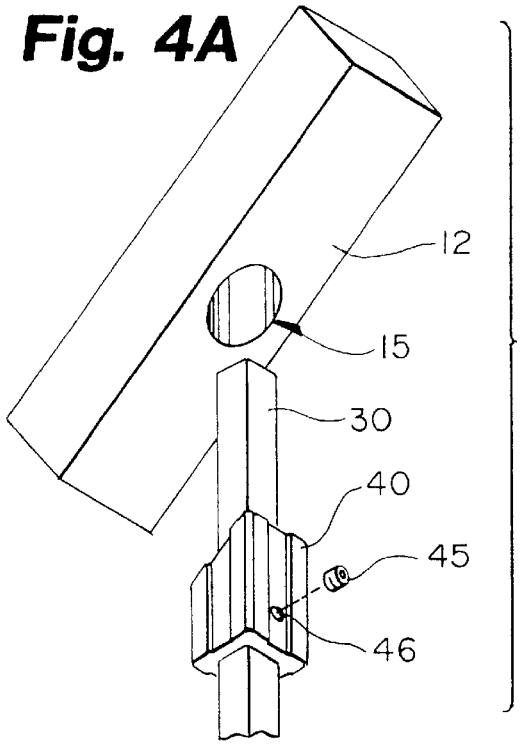
FIGS. 4A & 4B are side views of one embodiment of the invention showing a baluster, a handrail and a extruded escutcheon.
Figure 4B:
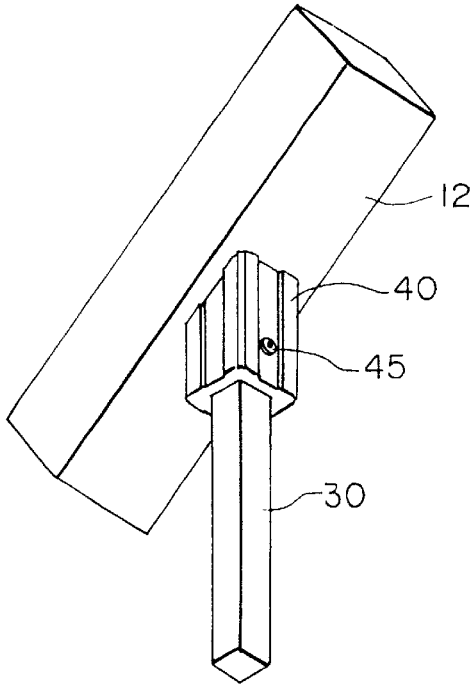

As shown in FIG. 2B the connector 20 can be shaped to be used to attach balusters 30 that intersect the base 10 and handrail 12 perpendicular to the baluster 30. As shown in FIG. 2A, the connector 20 can be shaped for use with balusters 30 that intersect the base 10 and handrail 12 at angles other than perpendicular to the baluster 30, or as shown in FIG. 2C, both types of connector 20 can be used together.

These connectors 20 may be sold alone, or as part of a baluster/handrail kit.

Also included in the present invention is a method of securing a baluster 30 to a base 10 or handrail 12 which includes the following steps. A particular design of baluster 30 must by chosen. The baluster 30 preferably has at least one end with a polygonal cross-section. Most commonly the cross-section will be square. A connector 20 which is generally cylindrical, must be provided. This connector 20 must have an internal axial channel 25 having a polygonal cross-section generally the same as that of the polygonal baluster end.

A suitable base 10 or handrail 12 must be available in which a generally circular opening 15 is made such that resulting opening 15 has a diameter substantially that of the connector 20. The connector is substantially inserted into said opening (with or without adhesive). The polygonal baluster end is also inserted into internal axial channel 25 (with or without adhesive).

As previously discussed, in some cases the use of escutcheons is desirable. One embodiment of the present invention is a method of efficiently and cost-effectively manufacturing baluster escutcheons. Several embodiments of escutcheons 40 consistent with this invention are shown in FIGS. 3A, 3B, 4A & 4B.

Such escutcheons are used to cover up the gaps left when a polygonal baluster 30 is inserted into a circular opening 15. While a number of designs are possible for these parts, the key to the present invention is the use of extrusions to efficiently manufacture the escutcheons.

This method for manufacturing a baluster escutcheon comprises the following steps. A baluster having at least one end with a polygonal cross-section must be selected. Metal is extruded into an extrusion by any number of methods well known in the art. While a wide range of extrudible metals can be used with this method, aluminum and brass are preferred.

The resulting extrusion will define an internal axial channel having substantially the same cross-sectional profile of the baluster end. The extrusion is then cut or severed at pre-selected axial lengths to form the extruded parts.

The resulting escutcheons 40 can be used with bases 10 as well as handrails 12. They may be secured by adhesives, set screws 45, or in some cases they will remain in place by gravity.

Figure 5A:
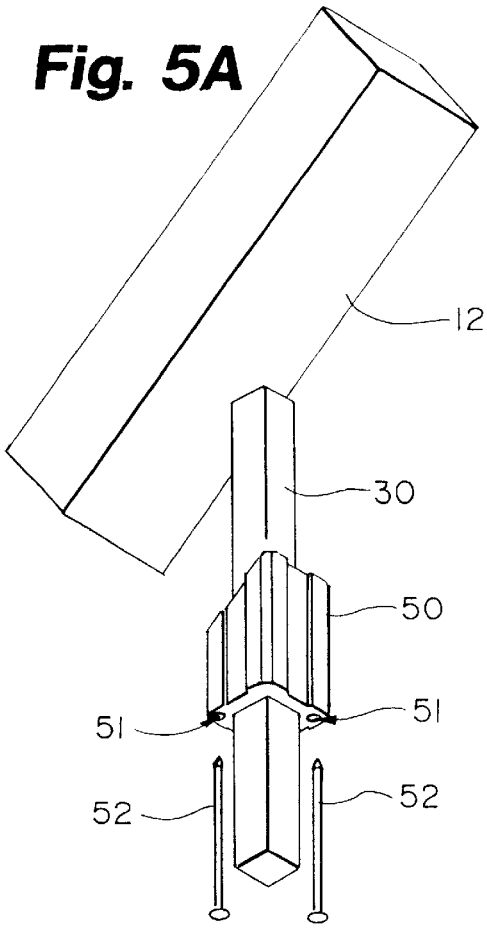
FIG. 5A is a side view of one embodiment of the invention showing a baluster, a handrail and a connector.
Figure 5B:
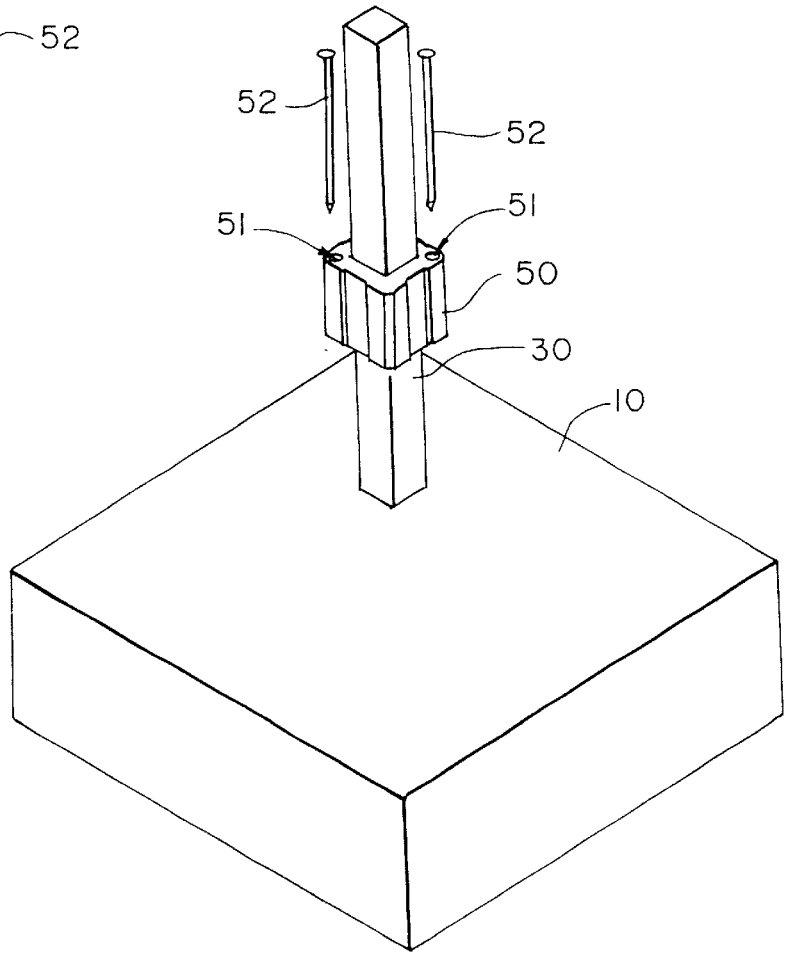
FIG. 5B is a side view of one embodiment of the invention showing a baluster, a base and a connector.

Another embodiment (as shown in FIGS. 5A & 5B) incorporates the additional step of forming at least one substantially cylindrical axial passage 51 placed generally about the periphery of the severed extruded part. The passage 51 is adapted to receive a fastener 52. Commonly used fasteners 52 would include screws and nails. In a preferred embodiment, two passages 51 would be created in opposing corners of the escutcheon 50. The passage 51 may be formed during extrusion, or by any number of machining techniques know in the art such as drilling.

The result is a connector 50 that will attach a baluster 30 to a base 10 or handrail 12 without the necessity of openings or holes in the base/handrail. Rather, fasteners 52 such as screws or nails can be inserted into the passages 51 and secured to the base/handrail.

Figure 6A:
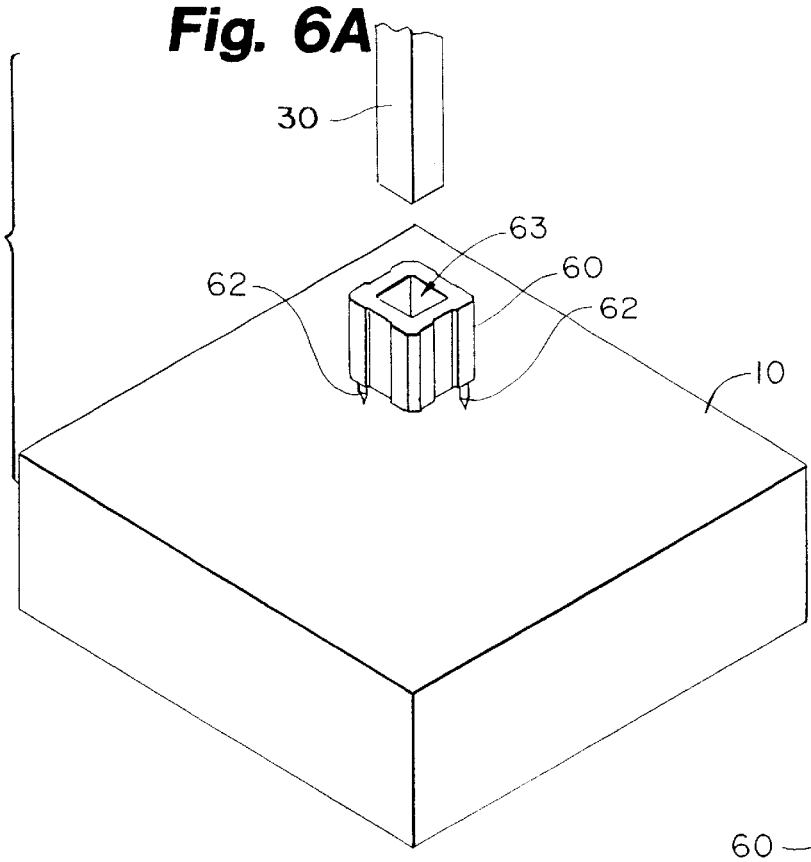
FIGS. 6A & 6C are side views of one embodiment of the invention showing a baluster, a base and a connector with studs.
Figure 6B:
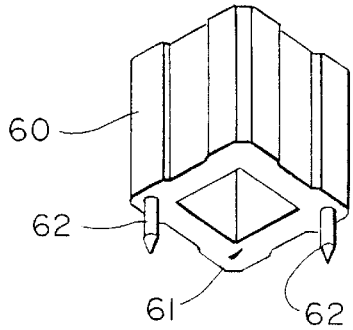
FIG. 6B is a larger side view of the embodiment of the invention of FIGS. 6A & 6C.
Figure 6C:
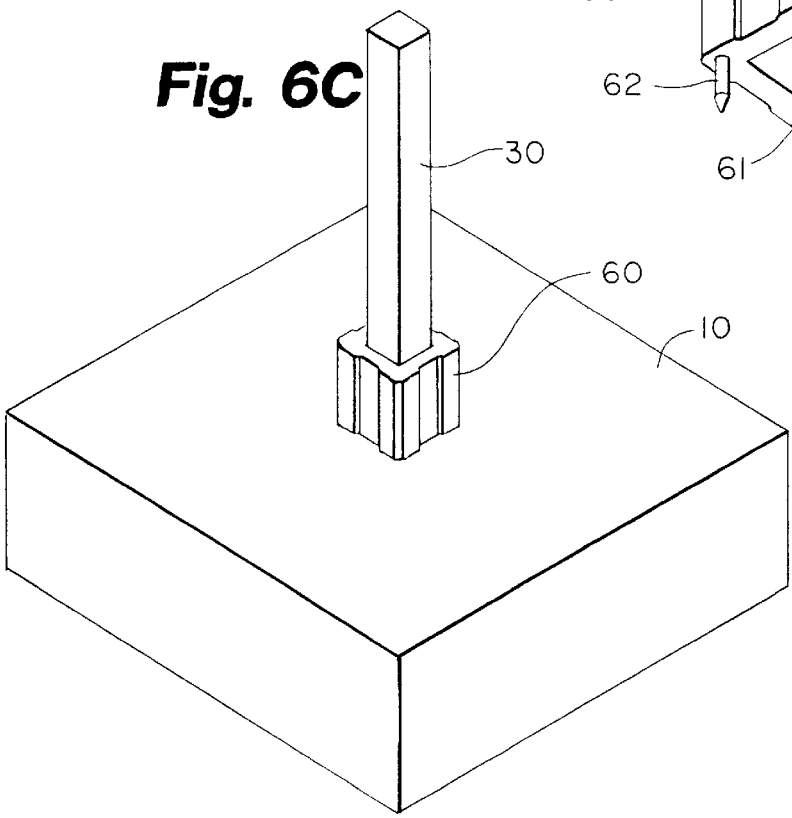
Figure 7A:
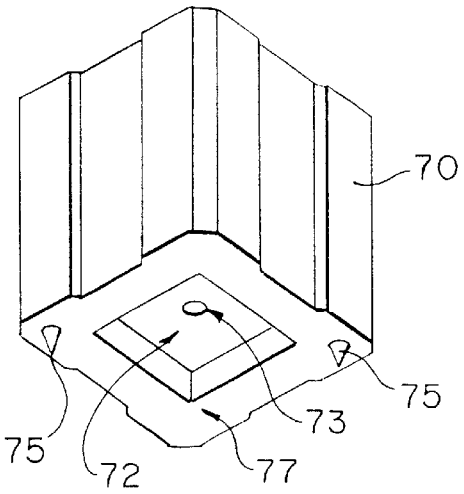
FIG. 7A is a side view of one embodiment of the invention showing a connector with studs and a orifice adapted to receive a fastener.
Figure 7B:
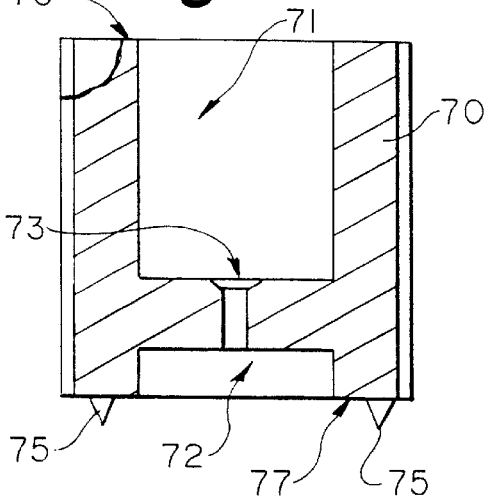
FIGS. 7B & 7C are cross-sectional views of the several embodiments of the present invention as shown in FIG. 7A.
Figure 7C:
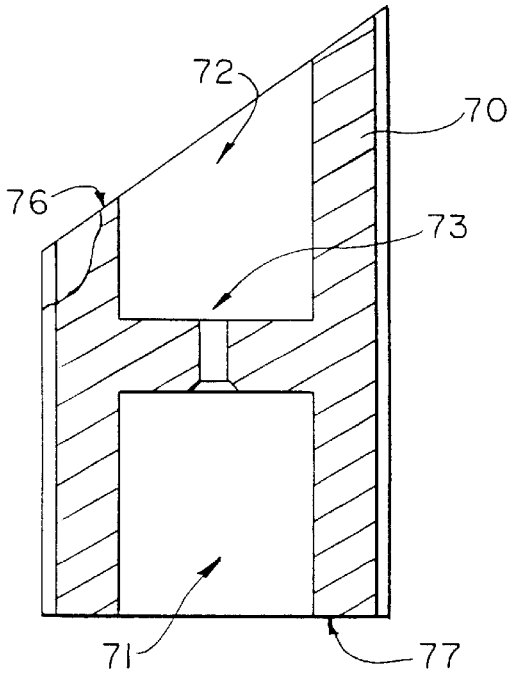
Figure 8A:
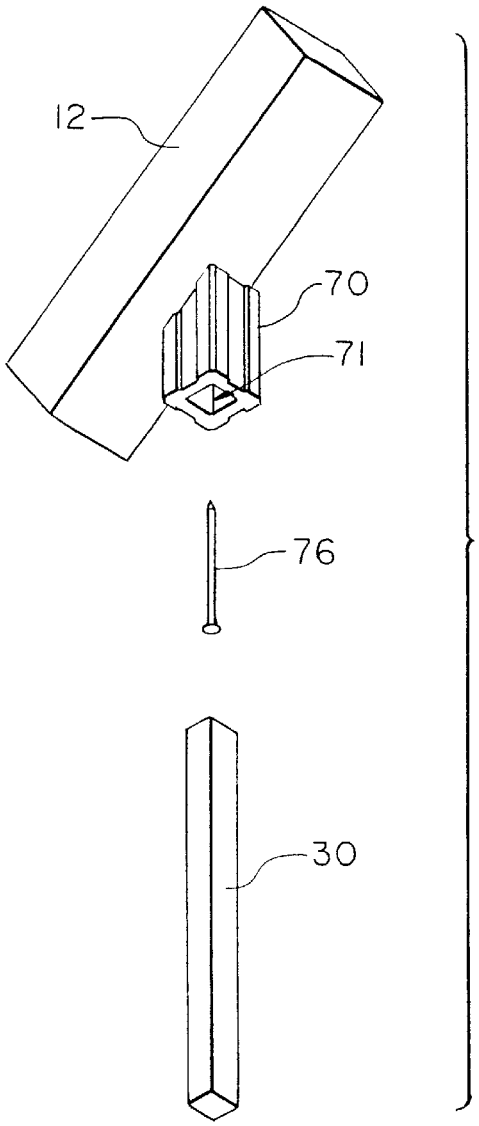
FIGS. 8A & 8B are side views of one embodiment of the invention showing a baluster, a handrail and a connector.
Figure 8B:
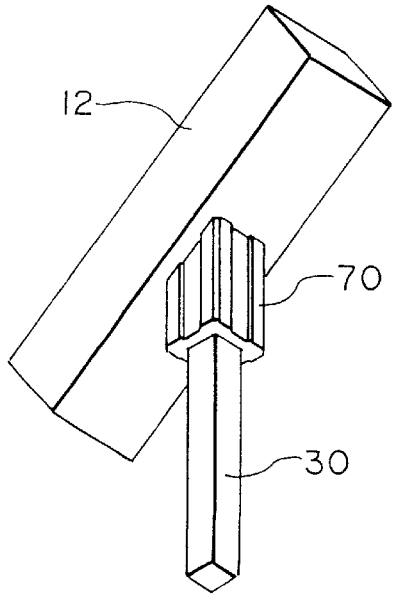

An additional embodiment (as shown in FIGS. 6A, 6B & 6C) provide another method of attaching a baluster 30 without drilling openings in the base 10 or handrail 12. The connector of this embodiment 60 has a bottom edge 61 and defines an internal axial channel or recess 63 that has a polygonal cross-section adapted to receive a selected baluster end.

The term bottom edge is being used throughout this document to refer to the edge of a connector which contacts a base or handrail, while the top edge refers to the opposing end. Generally, the bottom edge is found above the base but below the top edge, however, the connector may be used in any orientation. One example of an alternative orientation is the use of a connector to attach a baluster to a handrail as seen in various figures. In these examples, the "bottom edge" may actual be positioned above the "top edge."

The connector 60 also has at least one nail-like stud 62 on its bottom edge 61. The stud 62 is positioned generally about the periphery of the connector's bottom edge 61. Preferably, two studs 62 are positioned at opposing corners of the connector 60.

This connector 60 can be manufactured by extrusion, sand cast, die cast, metal stamped or by a number of methods well known in the art. Preferred materials for manufacture are aluminum, brass, cast iron and plastic.

In practice, the connector 60 is hammered, or otherwise forced into place on the base 10 or handrail 12. The baluster 30 is then inserted into the axial channel 63. Adhesives may be used to further secure the baluster in place.

Another embodiment of the present invention is shown in FIGS. 7A, 7B, 7C, 8A & 8B. Here a connector 70 is used to secure a baluster 30 to a base 10 or handrail 12 without drilling an opening.

The connector 70 has both top 76 and bottom 77 ends and a first axial recess 71 in the top end 76. This recess 71 is adapted to receive a selected baluster end. The connector also has a generally cylindrical axial orifice 73 passing from recess 71 to bottom end 77. This orifice is adapted to receive a fastener 78 such as a screw or a nail. Each connector 70 shown in FIGS. 7A–7C and 8A–8B is an integral body that defines both the first axial recess 71 and the generally cylindrical axial orifice 73.

In practice, the connector 70 is secured to the base 10 or handrail 12 via the fastener 78. The baluster 30 is then inserted into recess 71. The baluster may be further secured with an adhesive.

The term bottom end is being used throughout this document to refer to the end of a connector which contacts a base or handrail, while the top end refers to the opposing end. Generally, the bottom end is found above the base but below the top edge, however, the connector may be used in any orientation. One example of an alternative orientation is the use of a connector to attach a baluster to a handrail as seen in various figures. In these examples, the "bottom end" may actual be positioned above the "top end." In the alternate, the "top end" may also referred to as a "first end," and the "bottom end" referred to as a "second end."

This connector 70 can be manufactured by sand cast, die cast or by a number of similar methods well known in the art. Preferred materials for manufacture are zinc, aluminum, iron or plastic.

In an additional embodiment, the connector 70 incorporates a second recess 72 located in its bottom end 77. In this case, the generally cylindrical axial orifice 73 passes from top end recess 71 to bottom end recess 72. The second recess 72 serves to reduce the overall material necessary to manufacture the part. It also reduces the overall weight of the part.

In a preferred embodiment at least one small stud 75 attached to the bottom end 77 facilitates the attachment of said connector to the handrail 12 or base 10. The presence of the stud 75 reduces rotation of the connector 70 around the fastener 76. The stud 75 is positioned generally about the periphery of the bottom end 77. In a preferred embodiment, two studs 75 are positioned at opposing corners of the connector 70.

While a preferred embodiment of the present invention has been described, it should be understood that various changes, adaptations and modifications may be made therein without departing from the spirit of the invention and the scope of the appended claims.

What is claimed is:

1. A connector assembly comprising:

(a) a baluster;

(b) a connector having first and second ends, where said connector defines a first axial recess in said connector's first end, said first axial recess having therein received an end of the baluster, and where said connector further defines a generally cylindrical axial orifice passing from said first axial recess to said connector's second end, said generally cylindrical axial orifice having therein received a fastener; and (c) a handrail, stair, or floor, said fastener extending away from the baluster and into the handrail, stair, or floor, such that the connector is secured to the handrail, stair, or floor by said fastener.

2. The connector assembly of claim 1 wherein said connector's second end is in contact with the handrail, stair, or floor.

3. The connector assembly of claim 1 wherein said fastener is a screw or a nail.

4. The connector assembly of claim 1 wherein the connector is an integral body that defines both said first axial recess and said generally cylindrical axial orifice.

5. The connector assembly of claim 1 wherein the handrail, stair, or floor is a handrail.

6. A connector assembly comprising:

(a) a baluster having an end with a polygonal cross section;

(b) a connector having first and second ends, where said connector defines a first axial recess in said connector's first end, said first axial recess having a polygonal cross section and having therein received said end of the baluster, and where said connector further defines a generally cylindrical axial orifice passing from said first axial recess to said connector's second end, said generally cylindrical axial orifice having therein received a fastener; and (c) a handrail, stair, or floor, said fastener extending away from the baluster and into the handrail, stair, or floor, such that the connector is secured to the handrail, stair, or floor by said fastener.

7. The connector assembly of claim 6 wherein said end of the baluster has a square cross section, and wherein said first axial recess of the connector also has a square cross section.

8. A connector assembly comprising:

(a) a baluster;

(b) a connector having first and second ends, where said connector defines a first axial recess in said connector's first end, said first axial recess having therein received an end of the baluster, and where said connector further defines a generally cylindrical axial orifice passing from said first axial recess to said connector's second end, said generally cylindrical axial orifice having therein received a fastener;

(c) a handrail or base to which said connector is secured by means of said fastener; and (d) at least one stud attached to said connector's second end facilitating attachment of said connector to said handrail or base so as to reduce rotation of said connector about said fastener.

* * * * *